US005326525A

United States Patent [19]

Ghosh

[11] Patent Number: 5,326,525

[45] Date of Patent: Jul. 5, 1994

[54] CONSOLIDATION OF FIBER MATERIALS WITH PARTICULATE METAL ALUMINIDE ALLOYS

[75] Inventor: Amit K. Ghosh, Thousand Oaks, Calif.

[73] Assignee: Rockwell International Corporation, Seal Beach, Calif.

[21] Appl. No.: 217,253

[22] Filed: Jul. 11, 1988

[51] Int. Cl.[5] ..... B22F 3/14

[52] U.S. Cl. ..... 419/23; 419/4; 419/6; 419/10; 419/12; 419/14; 419/15; 419/16; 419/20; 419/21; 419/22; 419/48; 419/49; 428/549; 428/551; 428/553

[58] Field of Search ..... 419/8, 24

[56] References Cited

U.S. PATENT DOCUMENTS 4,853,294 8/1989 Everett et al. ..... 428/614

4,982,893 1/1991 Rvakle et al. ..... 228/220

*Primary Examiner*—Donald P. Walsh

*Assistant Examiner*—John N. Greaves

*Attorney, Agent, or Firm*—Charles T. Silberberg; Max Geldin

[57] ABSTRACT

A process is disclosed for fabricating a metal aluminide composite which comprises providing a metal aluminide, such as titanium aluminide, or a titanium aluminide alloy, and a reinforcing fiber material, such as silicon carbide fiber, and placing an interlayer or diffusion barrier layer in the form of a metal selected from the group consisting of silver, copper and gold, and alloys thereof, between the metal aluminide and the reinforcing fiber material. The interlayer metal can be a foil of the metal or in the form of a coating, such as a silver coating, on the reinforcing fiber material. The metal aluminide, the reinforcing fiber material, and the metal interlayer, e.g., in the form of a packet of a plurality of alternate layers of metal aluminide alloy and reinforcing fiber material, each layer being separated by the metal interlayer, is pressed and heated at an elevated temperature, e.g., ranging from about 900° to about 1200° C., at which diffusion bonding occurs. The diffusion barrier metal, e.g., silver, dissolves in the metal aluminide during consolidation of the metal aluminide matrix with the reinforcing fiber material. A layer of tantalum on silver can be employed as a second diffusion barrier layer, and a third layer, such as titanium alloy, can be applied over the tantalum layer, for increased effectiveness of the diffusion barrier, and preventing crack initiation.

29 Claims, 2 Drawing Sheets

FIG. 1(a)
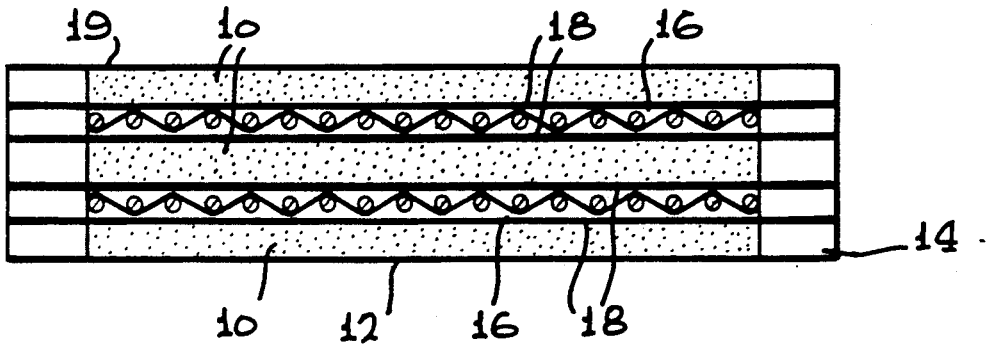
FIG. 1(b)
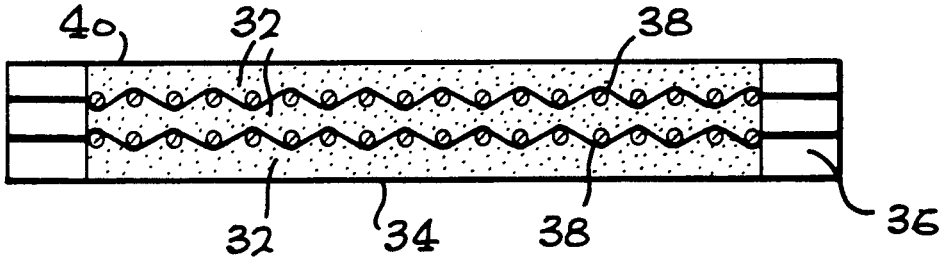
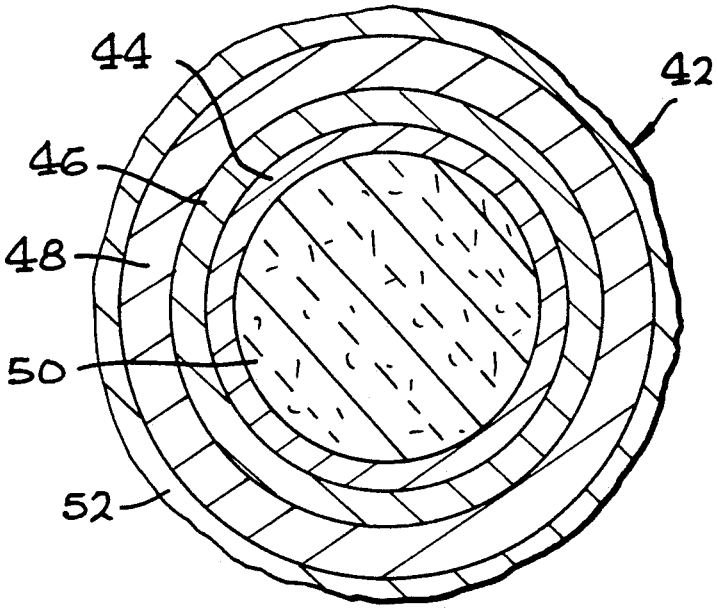
FIG. 4

FIG. 2
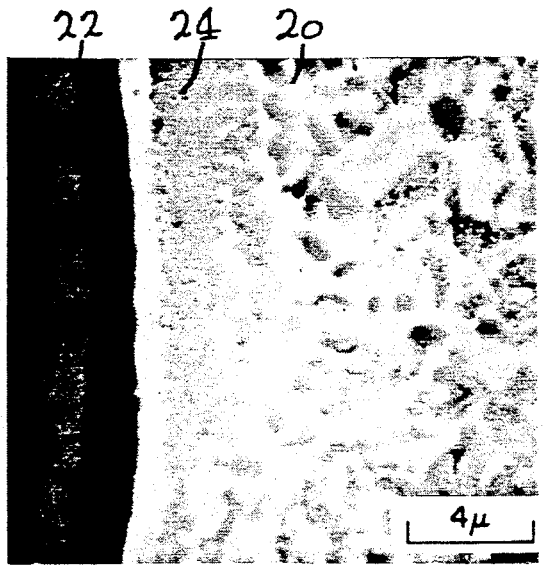
FIG. 3
PRIOR ART
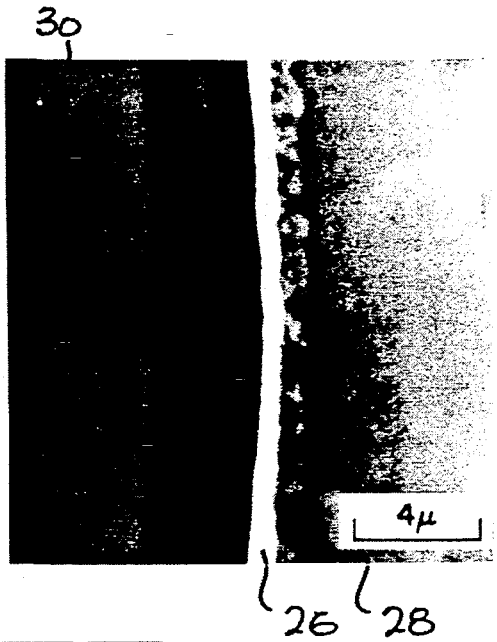
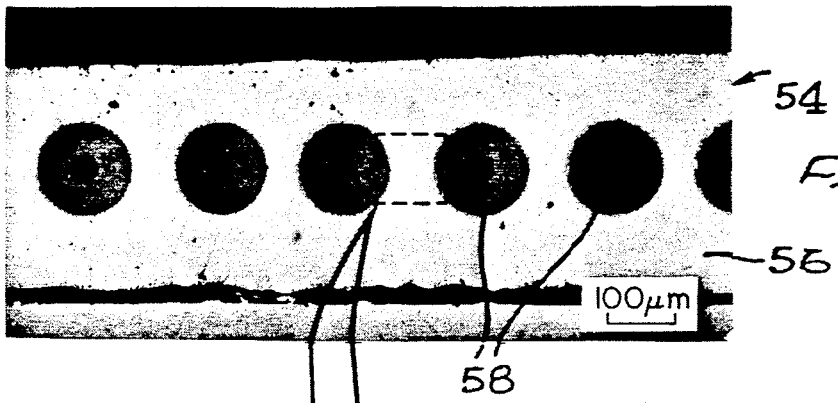
FIG. 5(a)
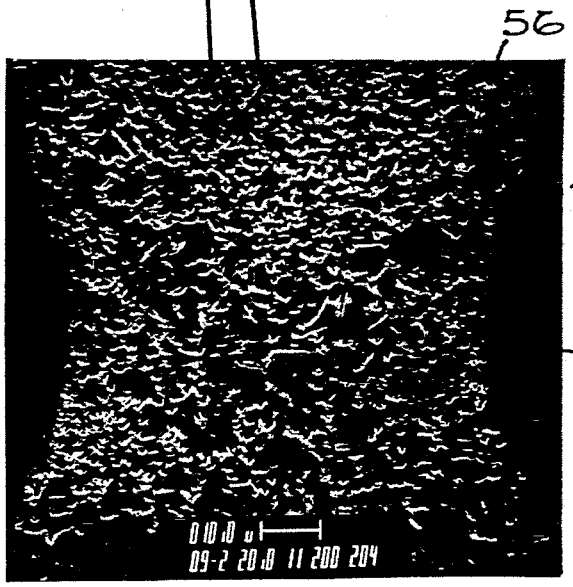
FIG. 5(b)

CONSOLIDATION OF FIBER MATERIALS WITH PARTICULATE METAL ALUMINIDE ALLOYS

BACKGROUND OF THE INVENTION

This invention relates to the field of composite structural materials and is particularly directed to metal aluminide fiber reinforced composite materials.

Performance requirement goals for future advanced airframe structures and gas turbine engines exceed the capabilities and limits of currently available materials and manufacturing technologies. Improvements in lightweight, high temperature materials and processes are required to meet the challenging goals. Metal aluminides, particularly titanium aluminide base alloys, offer opportunities for weight reduction compared to nickel base superalloys. To achieve the ambitious high temperature capability goal in a light and stiff material, it has been proposed to fabricate fiber reinforced composites using titanium aluminide base alloys as the matrix. However, as high strength and high temperature matrix materials are selected to provide high performance composites, it becomes more difficult to fabricate the composites because the temperatures and pressures required to consolidate the materials also increase.

Composites can be fabricated by placing a reinforcing material, such as silicon carbide fibers, between layers of a matrix material, such as a metal alloy. These ingredients are then consolidated into a composite by pressing them together at a temperature and pressure which will cause the matrix to flow around the reinforcing fibers and diffusion bond the matrix together.

At present, there is a great deal of interest in consolidating fiber composites with high temperature metallic matrices, such as titanium and nickel intermetallics ($Ti_3Al$, TiAl, $Ni_3Al$, NiAl). These alloys are being produced currently with several alloying additions in powder form via rapid solidification processing (RSP) technology. While the structural properties of the RSP powder alloys are desirable as matrix, powder consolidation directly with reinforcing fibers, e.g., SiC, causes several difficulties. At lower consolidation temperatures, the hard metallic particles can crack or mechanically damage fibers during hot pressing and hot isostatic pressing operations. At high consolidation temperatures, the reactive powder alloys can chemically react and degrade fibers. An additional problem is presented that if the powder particles surrounding the fibers are not well bonded or are too brittle, during cooldown from the fabrication temperature or subsequent thermal cycling in service, tensile stresses induced in the matrix can cause cracking of the matrix, e.g., typical mid-plane cracking between fibers.

Thus, in summary, the problems presented are (1) interfacial reaction between the metal alloy particles and the fiber materials leading to brittle reaction products formed near the interface, (2) there is a CTE (coefficient of thermal expansion) difference between the metal alloy and the reinforcing fibers which causes large tensile stresses in the metal alloy matrix, thereby tending to cause cracks, and (3) the metal matrix itself, that is, the metal aluminide, is a relatively brittle material and tends to crack easily.

In Applicant's copending U.S. application Ser. No. 182,676, filed Apr. 18, 1988, now U.S. Pat. No. 4,847,044, titled "A Method of Fabricating a Metal Aluminide Composite" and assigned to the same Assignee as the present application, there is disclosed adding to a metal aluminide composite during fabrication a soft metal phase, such as aluminum, or a metal forming a metal aluminide, or an alloy containing these metals, to promote consolidation of the metal aluminide matrix with the reinforcing phase. The softer metal, the metal aluminide matrix, e.g., titanium aluminide, and the reinforcing phase are pressed together at a temperature above the softening temperature of the softer metal. The softened metal promotes flow and consolidation of the matrix and the reinforcement at relatively low temperatures. The composite is held at an elevated temperature to diffuse and convert the soft metal phase into the metal aluminide matrix.

It is an object of the invention to provide a method of fabricating a metal aluminide composite by consolidation of a metal aluminide alloy and fibrous reinforcing material under conditions to produce a metal aluminide matrix composite having improved structural properties.

Another object is the provision of a method of fabricating a metal aluminide matrix composite without damaging the reinforcing fibrous material during hot pressing operations.

A further object of the invention is to provide a method of fabricating a metal aluminide matrix while minimizing or avoiding chemical reaction between the metal aluminide and the fibrous reinforcing material, to thereby avoid degradation of the fibers.

Yet another object of the invention is the provision of procedure for fabricating a metal aluminide matrix composite while reducing tensile stresses induced in the matrix during cooldown and subsequent thermal cycling, and avoiding cracking of the metal aluminide matrix under such conditions.

A still further object of the invention is to provide a method of fabricating a metal aluminide matrix composite formed between a metal aluminide matrix and a fibrous reinforcing material while enhancing the ductility of the matrix alloy.

Yet a further object of the invention is the provision of a method of fabricating a metal aluminide matrix composite by consolidation of a metal aluminide alloy, such as titanium aluminide, and a reinforcing fibrous material, such as silicon carbide fibers, by the addition of an element which achieves the aforementioned objects, and which also particuarly reduces the CTE mismatch between the metal aluminide matrix and the reinforcement fibers, thus minimizing crack formation in the metal matrix.

SUMMARY OF THE INVENTION

According to the invention, a protective layer or diffusion barrier, in the form of a metal selected from the group consisting of silver, copper and gold, and alloys thereof, separately or in conjunction with other metallic layers, as described more fully hereinafter, is disposed between a metal aluminide or metal aluminide alloy, such as titanium aluminide, and the reinforcing fiber material or phase, such as silicon carbide. The metal aluminide, the reinforcing fiber material and the diffusion barrier metal are pressed and heated at a temperature at which diffusion bonding occurs.

During the consolidation of the fiber reinforcing material with the metal aluminide via hot pressing at an elevated temperature suitable for diffusion bonding of the metal aluminide material, the diffusion barrier metal, such as silver either in solid or liquid state, functions to protect the fibrous material, such as silicon carbide, since such barrier metal is non-reactive toward C and Si present in SiC. However, the metal aluminide constituents diffuse through silver and can eventually attack SiC fiber. The consolidation process must therefore be completed before all of the diffusion barrier metal, such as silver, in the immediate vicinity of the reinforcing fiber, such as silicon carbide fiber, is completely depleted, and before metal aluminide constituents diffuse through the silver, to avoid commencement of any reaction with the silicon carbide fiber. The added diffusion barrier metal which dissolves in the metal aluminide during consolidation of the metal aluminide matrix with the fibrous reinforcement material, becomes a part of the metal aluminide matrix and the resulting composite.

The diffusion barrier or interlayer metal, such as silver, can be employed as an interleaf foil between the reinforcing fiber and the metal aluminide matrix. Alternatively, the diffusion barrier metal, such as silver, can be applied as a coating on the reinforcing fiber surface, such as silicon carbide fiber, e.g., in the form of a mat. In either case, multilayer or multi-ply metal aluminide-reinforcing fiber composites can be fabricated utilizing the above-described invention principle.

In addition to functioning as a diffusion barrier to prevent reaction between the reinforcing fiber and metal aluminide matrix during consolidation, thus eliminating brittle product formation, the diffusion barrier metal, e.g., silver, is also ductile, which reduces the tendency toward crack formation. In addition, the metal diffusion barrier layer has a CTE somewhat greater than that of the metal aluminide matrix, tending to fill up the space which might otherwise be created between the matrix metal and the reinforcing fiber when the composite is subsequently heated up, thus providing firm contact between them for load transfer.

When it is desirable to use higher consolidating temperatures to achieve complete consolidation, interdiffusion between silver and metal aluminide must be prevented. In this case, a layer of tantalum is used as a second diffusion barrier layer on silver, which prevents the diffusion of metal aluminide constituents. Furthermore, Ta is non-reactive with silver, and by virtue of its high ductility, it promotes crack retardation near the fiber interface. A third ductile layer on Ta can be employed, in the form of an alloy of the metal in the metal aluminide matrix which is highly ductile, such as $\beta$-titanium alloy in the case of titanium aluminide matrix. Thus, a one to three layer fiber interfacial treatment can be utilized to achieve the overall objectives of the invention. Multiple layers also allow reduction of stresses on the metal aluminide matrix near the fiber interface, thereby further minimizing tendencies for crack formation.

These and other objects and features of the invention will be apparent from the following detailed description taken in connection with the accompanying drawings.

DESCRIPTION OF THE DRAWINGS

FIG. 1(*a*) is a schematic illustration of the preparation of a lay-up of a plurality or packet of alternate layers of titanium aluminide powder and silicon carbide fiber mats separated by silver foil, according to the invention;

FIG. 1(*b*) is a schematic illustration of the preparation of a packet formed of a plurality of alternate layers of titanium aluminide powder and of silicon carbide fiber mat coated with silver, according to the invention;

FIG. 2 is a photomicrograph of a cross-section of a composite according to the invention, showing the absence of any reaction zone between titanium aluminide and silicon carbide when using silver interleaf;

FIG. 3 is a photomicrograph of a prior art composite showing a reaction zone between the titanium aluminide and the silicon carbide fiber matrix, in the absence of any barrier layer, such as silver;

FIG. 4 is a schematic illustration of a three-layer interface treatment for SiC-fiber reinforced titanium aluminide matrix composite;

FIG. 5(*a*) is a photomicrograph of a composite produced according to the invention employing silver foil with an $\alpha_2$ titanium aluminide matrix and SiC fibers, showing the composite to be completely consolidated; and FIG. 5(*b*) is an enlarged view of a portion of FIG. 5(*a*) within the dotted square inset of FIG. 5(*a*), showing no interfacial reaction and the absence of cracks.

DETAILED DESCRIPTION OF THE INVENTION AND PREFERRED EMBODIMENTS

Titanium aluminide matrix material is diffusion-bondable at a fairly high temperature of the order of 800°-1200° C. The higher the temperature, the lower the required pressure level and time required for consolidation. Mechanical damage, as well as damage due to chemical reaction to the fibers, is reduced if a higher temperature could be used for consolidation. By employment of a protective metal layer, such as silver, according to the invention, such higher temperature of consolidation can be utilized. Typically, RSP powder titanium aluminides which contain Nb, Er and Mo additions to $Ti_3Al$ have high flow stress and do require a higher temperature for consolidation. Ag, Cu and Au have higher melting temperatures within the above range and are soluble in titanium alloys. Of these, silver is not as likely to form precipitates with titanium as copper. Further, due to higher solid solubility and beta-phase formation, silver enhances the ductility of titanium aluminides.

Both copper and silver are inert with many fiber materials; however, silver, being a noble metal, has even less reactivity than copper, with high modulus fibers, such as silicon carbide. Typically, these fibers are available with a carbon-rich coating, which has essentially no reactivity with silver. Thus, silver is an excellent diffusion barrier for silicon carbide fibers and is the preferred interface material for the purposes of the invention.

During the consolidation process, the diffusion barrier metal, such as silver, becomes viscous or melts and flows around the fibers. However, as the silver dissolves in titanium aluminide, this diffusion barrier begins to be depleted. The consolidation process must therefore be over before all silver in the immediate vicinity of the reinforcing fiber, such as silicon carbide fiber, is completely depleted, and reaction between fiber and titanium commences. Consequently, consolidation via diffusion bonding of powder particles is achieved with no damage to the fibers.

The matrix metal aluminide can be employed in powder or foil form. In the preferred embodiment, the matrix used for the composite is titanium aluminide or an alloy containing titanium aluminide. Other embodiments of the invention include employment of either nickel aluminides or iron aluminides to form the matrix of the composite. The latter aluminides are analogous to the titanium aluminides, and the composites produced therefrom according to the invention can be fabricated by a method analogous to that for fabricating titanium aluminide composites.

Numerous reinforcing materials are available and can be employed in the present invention. These include, in addition to silicon carbide, graphite, alumina, boron, titanium diboride and boron carbide fibers. The fibers can be in the form of mats containing parallel fibers. Selection of a particular fiber depends upon the properties required in the particular composite, the compatibility of the fiber with the matrix material during fabrication and during use of the composite and other considerations within the skill of the artisan.

In place of silver, copper or gold as diffusion barrier metal, alloys thereof can be employed in which the major metal component is silver, copper or gold, and containing minor amounts of alloying constituents. Thus, for example, silver, copper or gold in the form of alloys containing a metal constituent of the reinforcing fiber can be utilized. Thus, where silicon carbide is employed as reinforcing filber, a Ag-Si alloy, a Cu-Si alloy or a Au-Si alloy can be used as diffusion barrier metal. Where boron is utilized as reinforcing fiber, a Ag-B, Cu-B or Au-B alloy can be employed as diffusion barrier metal, and where alumina is utilized as reinforcing fiber, a Cu-Al or Au-Al alloy diffusion barrier metal can be utilized. However, the use of the diffusion barrier metals silver, copper and gold is preferred, particularly silver.

As previously noted, the metal diffusion barrier or separator layer, such as silver, can be in the form of an interleaf foil, e.g., of a thickness of about 2 um to about 15 um placed between the reinforcing fiber and the metal aluminide matrix. However, this tends to introduce more of the barrier metal, such as silver, than is necessary. Consequently, silver has also been applied as a coating, e.g., on a silicon carbide fiber or fiber mat surface. Such coating can be applied by physical vapor deposition of silver on the reinforcing fiber, such as silicon carbide, although other methods can also be employed. A coating thickness of the order of about 2-10 μm appears to be adequate Titanium diffusion through silver is rather sluggish, thereby preventing titanium atoms from reaching the SiC reinforcing fiber to form brittle TiC and $Ti_5Si_3$ compounds. As diffusion retardants, copper and gold function in a similar way, although some chemical reactivity is present with these materials.

According to one embodiment of the invention, as illustrated in FIG. 1(*a*), titanium aluminide powder in an alcohol slurry, as indicated at 10, is distributed on a base foil 12 of titanium or tantalum, positioned within a frame 14. A silicon carbide fiber mat 16 is positioned over the titanium aluminide powder layer 12, with a silver foil 18 positioned between the titanium aluminide powder layer 10 and the silicon carbide fiber mat 16 within the frame. Additional titanium aluminide powder packets or layers 10 are laid up with alternate layers of fiber mats 16, and with silver foil layers 18 separating the powder and fiber mat layers, within the frame. A top or cover foil 19 of titanium or tantalum is placed over the top layer 10 of titanium aluminide powder.

Consolidation of the resulting pack involves hot outgassing at 400°-500° C., e.g., for about 1-2 hours, after being placed in a vacuum bag. Subsequently, the pack is placed in a platen press, heated to the consolidation temperature in a range broadly from about 900° to about 1200° C., depending upon the matrix alloy and the diffusion barrier employed, while applying pressure ranging from about 500 to about 10,000 psi. When employing a silver interlayer, consolidation temperature can range from about 920° to about 1050° C.

In the present embodiment, the hot platen press is heated at 920° C. under a light load (500 psi). Since silver becomes viscous at this temperature, it flows around the fiber interface, thereby allowing the titanium aluminide powder particles to flow between fibers. The temperature is raised rapidly to 982° C., at which time a pressure of 2,000-10,000 psi is applied on the pack. The temperature is then made to increase continuously to 1050° C. where load is maintained for approximately 30-45 minutes to cause diffusion bonding of the titanium aluminide powder particles around the silicon carbide fibers. The composite is then cooled under load to reduce any tendencies for cracking due to thermal stresses.

FIG. 2 is a photomicrograph of a sample fabricated as described above with a silver interleaf between the titanium aluminide matrix and silicon carbide fiber, according to the invention. In FIG. 2, numeral 20 shows the titanium aluminide matrix and numeral 22 shows the fiber reinforcement portion, with a silver-rich layer indicated at 24 in the titanium aluminide layer, adjacent to and separating such layer from the silicon carbide fiber layer 22. It is clearly seen that any reaction zone products, such as TiC and $Ti_5Si_3$, are completely eliminated by using Ag interleaf, which prevents migration of Ti from the titanium aluminide layer to the SiC layer. There is no interface damage visible from such photomicrograph, and this composite is suitable for service up to 900° C.

On the other hand, FIG. 3 is a photomicrograph of a sample composite fabricated according to the prior art by consolidation of a pack formed of alternate titanium aluminide matrix and silicon carbide fiber layers at a temperature below 1000° C. and in the absence of a silver interleaf between layers. As seen in FIG. 3, there is a reaction zone 26 between the titanium aluminide matrix 28 and the silicon carbide fiber layer 30. The reaction zone 26 can contain reaction products of the titanium aluminide and silicon carbide fiber, including TiC, $Ti_5Si_3$ and aluminum carbide.

Now referring to FIG. 1(*b*), there is shown another embodiment of the invention process for consolidating titanium aluminide powder and silicon carbide reinforcement fibers. In this embodiment, titanium aluminide powder slurry as indicated at 32 is disposed on a tantalum or titanium base foil 34 positioned within a frame 36, as in FIG. 1(*a*). However, in the present embodiment, silicon carbide fibers supplied by AVCO Specialty Materials Division of Textron in the form of a mat cross-woven with Ti-6Al-4V wires is employed. These mats are coated by vapor deposition with silver, and the resulting silver-coated silicon carbide fiber mat, indicated at 38, is positioned over the titanium aluminide powder layer 32 within the frame 36. Then, additional alternate layers of powder 32 and one or more silicon carbide coated fiber mats 38 are added within the frame 14. A top or cover foil 40 of titanium or tantalum is then applied.

The consolidation of the resulting pack shown in FIG. 1(*b*) is carried out in a similar manner as described above with respect to the pack illustrated in FIG. 1(*a*). The microstructure of the resulting composite is similar to that shown in FIG. 2, with a silver-rich layer positioned between the titanium aluminide matrix and the silicon carbide fiber mat, and protecting the fibers from chemical degradation and stress.

The titanium alloy wires used for cross-weaving silicon carbide fiber mat in the embodiment described in FIG. 1(*b*) has shown some problems of chemical reaction with silicon carbide fiber. Further, since these wires are work-hardened, they stress-relieve during heat-up, leading to uneven fiber distribution. To avoid these problems, silver wires can be used to weave these mats. This results in the fabrication of an improved composite.

An additional beneficial effect of the employment of a diffusion barrier metal or transition layer, such as silver, in the consolidation of a metal aluminide and a fiber reinforcing material, according to the invention, is the alleviation of mismatch in the coefficient of thermal expansion between the ceramic reinforcing fiber and the titanium aluminide matrix. The CTE for titanium aluminide matrix, Ag and SiC fiber reinforcement are $13\times10^{-6}$/°C, 20-28$\times10^{-6}$/°C and $6\times10^{6}$/°C, respectively. Without a transition layer, ΔCTE between the matrix and reinforcement is approximately $7\times10^{-6}$/°C which places the interface in tension and shear when the composite is heated.

However, the CTE of the Ag layer is higher than the CTE of titanium aluminide. Thus, while heating the composite, the Ag diffusion barrier or transition layer will expand more than the titanium aluminide, i.e., its volume expansion will be greater. This means that the open space that would otherwise have been created between titanium aluminide particles and SiC fiber will be more than filled by the expansion of Ag. In fact, Ag expansion being greater, a compressive force will be felt by the titanium aluminide matrix, thereby minimizing any tendency for fracture. This allows for interfacial slippage without crack formation through the deformation of the Ag layer. No significant problem is presented during cooling of the structure since initially thermal contraction will reduce only compressive residual stresses. This minimizes the degree of tension that may accumulate at the interface between titanium aluminide and the Ag transition layer. Thus, Ag as a transition layer can take up the CTE mismatch between titanium aluminide and SiC fiber and prevent interface cracking during thermal cycling.

Silver as a coating for SiC fiber, or as an interleaf, during consolidation of such fibers in titanium aluminide, is effective as a barrier layer according to the invention, since it is non-reactive with carbon and dissolves only a very small amount of silicon. At higher consolidation temperatures, however, Ag does react with Ti to form a number of solid solutions and compounds. While small amounts of Ag may not pose any problem, larger amounts of Ag and longer exposure times can cause detrimental reaction products at composite interfaces.

To avoid this problem, a layer of Ta can be maintained between the titanium aluminide matrix and the Ag layer (or Ag-coated SiC fiber). Ta does not react with Ag and is highly compatible with Ti alloys. Ta is also ductile and in some cases improves the ductility of Ti alloys. The thickness of the Ta layer can be within the same range of thickness as Ag interleaf foil, as noted above, namely, about 2 μm to about 15 μm. Thus, a preferred interface arrangement can be a 5 μm Ag layer on SiC, e.g., SCS-6 fiber, a 5 μm Ta layer on Ag layer, and then titanium aluminide matrix.

A simple method for achieving this is by making a thin Ta foil packet filled with titanium aluminide powder. The Ag coating or interleaf can be directly applied to the outside Ta layer of this foil packet. When SiC fiber mats are sandwiched between such powder packets, with such fiber mats in contact with a Ag layer of adjacent packets, and the assembly consolidated, the desired result can be achieved, without actually Ag-coating the fibers. Alternatively, coatings of Ag and Ta can be applied to the fiber which is then consolidated with titanium aluminide powder. As a further alternative, the fiber can be Ag-coated and then consolidated between uncoated Ta packets containing titanium aluminide powder.

A third layer in the form of a ductile alloy of the metal in the metal aluminide matrix, e.g., a ductile titanium alloy in the case of titanium aluminide, can be applied over the tantalum layer and adjacent to the titanium aluminide matrix to increase the effectiveness of the diffusion barrier and prevent crack initiation. Such metal alloy layer can have a thickness of about 2 μm to about 15 μm. Where nickel aluminides or iron aluminides are employed as metal aluminide matrix, such third layer can be ductile nickel or iron base alloys.

FIG. 4 illustrates schematically a composite 42 formed of three interfacial layers 44, 46 and 48 on SiC fiber 50 and a titanium aluminide matrix 52, as described above. The first layer 44 is a diffusion barrier layer, such as Ag, which also functions to accommodate the CTE mismatch and arrest cracks. The second layer 46, such as Ta, represents a diffusion barrier between titanium aluminide 52 and Ag 44 and also acts as a ductile layer. The third layer 48 adjacent to the titanium aluminide 52 can be a β-titanium alloy which acts as a crack arrester.

The following are examples of practice of the invention:

EXAMPLE 1

$\alpha_2$ titanium aluminide (Ti-25Al-11Nb-3Mo-.8Er) powder, gas atomized by Pratt and Whitney, is used as the starting matrix alloy. The reinforcement is SiC fiber with C-rich coating produced by AVCO Speciality Materials. A unidirectional mat of these fibers is placed between 1 mil thick Ag foils and placed in a frame containing alternate layers of the alloy powder matrix, substantially as described above in relation to FIG. 1(*a*). With Ta foil top and bottom cover sheets placed on the packet to act an as oxygen getter and a parting agent, the packet is placed in a stainless steel bag and evacuated to $10^{-6}$ Torr. After outgassing for 1-2 hours at 400°-500° C., the bag is placed in a heated press with platens preheated to a temperature in the range of 920°-1050° C.

After further outgassing for 15-20 minutes under a dynamic vacuum, the pack is lightly loaded to 500 psi as the Ag foil is totally melted. Subsequently, a pressure of 10,000 psi is applied to cause powder flow and consolidation via diffusion bonding. Total consolidation is achieved in 20-80 minutes, depending on the temperature used. The packet is cooled under load. The microstructure of the consolidated product 54 of titanium aluminide alloy 56 and SiC fiber 58 is shown in FIGS. 5(*a*) and 5(*b*). As seen in FIGS. 5(*a*) and 5(*b*), the composite appeared to be completely consolidated, with no mid-plane cracks visible and no interfacial reaction products present.

EXAMPLE 2

The procedure of Example 1 is essentially followed except that in place of the use of a silver foil, fiber mats as described in Example 1 are employed, the fiber mat having a coating of silver vapor deposited on the fibers on both sides of the mat. In this example, the matrix titanium aluminide powder is sprayed onto opposite sides of the fiber mats containing the silver coating to form a packet, as generally illustrated in FIG. 1(*b*), of alternate layers of silver-coated silicon carbide fiber mats and titanium aluminide powder.

Consolidation of the resulting packet essentially as described in Example 1 results in a composite having improved properties similar to the composite produced in Example 1.

EXAMPLE 3

The procedure of Example 1 is substantially followed except that the consolidation processing cycle is carried out in a hot isostatic press with a sealed vacuum bag.

From the foregoing, it is seen that the invention provides a novel process for producing improved structural composites of a metal aluminide, particularly titanium aluminide, with reinforcing fibers, particularly silicon carbide fibers, utilizing certain metals, particularly silver, as an interleaf between the metal aluminide powder and the reinforcing fibers, or as a coating on the silicon carbide fiber, during consolidation of these fibers in the titanium aluminide matrix. Such metal foil or metal coating on the reinforcing fiber has the important properties of being soluble in the metal aluminide matrix alloy, melts at a temperature at which diffusion bonding between the metal powder particles is facilitated, does not chemically attack the reinforcing fiber and, in addition, enhances ductility of the metal aluminide matrix alloy. Such metal acts as a diffusion barrier against passage of matrix metal or alloy into contact with reinforcing fiber, and minimizes interfacial reaction resulting in brittle product formation, and also takes up or compensates for the CTE mismatch between matrix metal and reinforcement, and allows slippage at the interface between the metal aluminide and the reinforcing fibers via deformation of a high ductility phase, without crack initiation.

As an additional feature, for greater effectiveness in preventing reaction between the Ag layer and Ti in the matrix alloy, a second layer of Ta can be applied to the Ag, and if desired, a third layer in the form of an alloy of the metal in the metal aluminide matrix, such as titanium alloy, can be applied to the Ta layer.

Since various modifications of the invention will occur to those skilled in the art, without departing from the spirit of the invention, the invention is not to be taken as limited except by the scope of the appended claims.

What is claimed is:

1. A method for fabricating a metal aluminide composite which comprises:

providing a metal aluminide, providing a reinforcing fiber material, placing a diffusion barrier metal selected from the group consisting of silver, copper and gold, and alloys thereof, between said metal aluminide and said reinforcing fiber material, and pressing and heating the metal aluminide, the reinforcing fiber material and the diffusion barrier metal at a temperature at which diffusion bonding occurs.

2. The method of claim 1, including maintaining pressure and heating at said elevated temperature for a period sufficient to cause dissolution of said diffusion barrier metal into said metal aluminide and consolidation of said reinforcing fiber material and said metal aluminide via diffusion bonding of the metal aluminide.

3. The method of claim 1, wherein the reinforcing fiber material is selected from the group consisting of silicon carbide, boron, titanium diboride, alumina, graphite and boron carbide fibers.

4. The method of claim 1, wherein said reinforcing fiber material is silicon carbide fibers.

5. The method of claim 1, wherein said diffusion barrier metal is a foil of metal.

6. The method of claim 1, wherein said diffusion barrier metal is a coating of said metal on said reinforcing fiber material.

7. The method of claim 1, wherein said diffusion barrier metal is silver.

8. The method of claim 7, including placing a layer of tantalum as a second diffusion barrier layer on said silver, and pressing and heating the metal aluminide, the reinforcing fiber material, said silver and said tantalum layer at a temperature at which said silver flows.

9. The method of claim 8, including placing a layer of a ductile alloy of the metal of said metal aluminide on said tantalum layer, and pressing and heating the metal aluminide, the reinforcing fiber material, said silver, said tantalum layer and said alloy layer at a temperature at which said silver flows.

10. The method of claim 1, wherein said metal aluminide is in powder or foil form.

11. The method of claim 1, wherein said metal aluminide is a titanium aluminide alloy.

12. A method for fabricating a titanium aluminide composite which comprises:

providing a titanium aluminide, providing reinforcing silicon carbide fibers, placing an interlayer of a metal selected from the group consisting of silver, copper and gold, and alloys thereof, between said titanium aluminide and said reinforcing fibers, and pressing and heating the titanium aluminide, the reinforcing fibers and said metal at a temperature at which said metal flows and the titanium aluminide is diffusion bonded around said reinforcing fibers.

13. The method of claim 12, including maintaining pressure and heating at said elevated temperature for a period sufficient to permit said metal to flow between the titanium aluminide particles and said fibers, and cause diffusion bonding of the titanium aluminide powder particles.

14. The method of claim 12, including heating the titanium aluminide, the reinforcing fibers and said metal at a temperature between about 900° and about 1200° C. and at pressures of about 500 to about 10,000 psi.

15. The method of claim 12, wherein said interlayer metal is silver.

16. The method of claim 15, including heating the titanium aluminide powder, the reinforcing fibers and said silver at a temperature of between 920° and 1050° C. and at pressures of about 2,000 to about 10,000 psi.

17. The method of claim 12, wherein said metal is a foil of metal having a thickness ranging from about 2 to about 15 μm.

18. The method of claim 12, wherein said reinforcing fibers are in the form of a mat and said metal is coated on said fibers.

19. The method of claim 18, the thickness of said metal coating ranging from about 2 to about 10 μm.

20. The method of claim 17, wherein said titanium aluminide and said silicon carbide fibers are laid up in a plurality of alternate layers, each of said layers separated by said metal foil.

21. The method of claim 20, wherein said silicon carbide fibers are in the form of a mat.

22. The method of claim 20, wherein said metal is silver.

23. The method of claim 18, wherein said fiber mat coated with said metal and said titanium aluminide are laid up in a plurality of alternate layers.

24. The method of claim 23, wherein said metal is silver.

25. The method of claim 12, employing hot isostatic pressing.

26. A method for fabricating a titanium aluminide composite which comprises:

providing a titanium aluminide, providing reinforcing silicon carbide fibers, placing an interlayer of silver between said titanium aluminide and said reinforcing fibers, placing a layer of tantalum between said titanium aluminide and said silver interlayer, and pressing and heating the titanium aluminide, the silicon carbide fibers, said silver interlayer and said tantalum layer at a temperature to consolidate the resulting assembly and diffusion bonding said titanium aluminide around said silicon carbide fibers.

27. The method of claim 26, including placing a layer of a ductile titanium alloy between said tantalum layer and said titanium aluminide, and pressing and heating the titanium aluminide, the silicon carbide fibers, said silver interlayer, said tantalum layer and said titanium alloy layer at a temperature to consolidate the resulting assembly and diffusion bonding said titanium aluminide around said silicon carbide fibers.

28. The method of claim 27, the thickness of said silver interlayer, said tantalum layer and said titanium alloy layer ranging from about 2 to about 15 μm.

29. The method of claim 1, wherein said barrier metal is an alloy of said metal containing a metal constituent of said reinforcing fiber material.

* * * * *